US009933145B2

(12) United States Patent
Chen et al.

(10) Patent No.: US 9,933,145 B2
(45) Date of Patent: Apr. 3, 2018

(54) LED LIGHTING DEVICE

(71) Applicant: Hangzhou HPWinner Opto Corporation, Hangzhou, Zhejiang (CN)

(72) Inventors: Kai Chen, Zhejiang (CN); Jianming Huang, Zhejiang (CN); Huali Lu, Zhejiang (CN)

(73) Assignee: HANGZHOU HPWINNER OPTO CORPORATION, Hangzhou, Zhejiang (CN)

( * ) Notice: Subject to any disclaimer, the term of this patent is extended or adjusted under 35 U.S.C. 154(b) by 525 days.

(21) Appl. No.: 14/385,468

(22) PCT Filed: Mar. 15, 2013

(86) PCT No.: PCT/CN2013/072723
§ 371 (c)(1),
(2) Date: Dec. 17, 2014

(87) PCT Pub. No.: WO2013/135200
PCT Pub. Date: Sep. 19, 2013

(65) Prior Publication Data

US 2015/0103523 A1 Apr. 16, 2015

(30) Foreign Application Priority Data

Mar. 15, 2012 (CN) ..... 2012 1 0068550
Mar. 15, 2012 (CN) ..... 2012 2 0097776 U
Jul. 11, 2012 (CN) ..... 2012 2 0581722 U

(51) Int. Cl.
*F21V 29/00* (2015.01)
*F21V 21/16* (2006.01)
(Continued)

(52) U.S. Cl.
CPC ..... *F21V 21/116* (2013.01); *F21V 21/30* (2013.01); *F21V 29/004* (2013.01); *F21V 29/70* (2015.01);
(Continued)

(58) Field of Classification Search
CPC . F21V 29/2293; F21V 29/2206; F21V 21/116
See application file for complete search history.

(56) References Cited

U.S. PATENT DOCUMENTS 5,823,665 A * 10/1998 Braun ..... F21S 8/086 362/376
8,021,026 B2 * 9/2011 Liu ..... F21S 8/086 362/287
(Continued)

FOREIGN PATENT DOCUMENTS

CN 201145167 Y 11/2008
CN 101871605 A 10/2010
(Continued)

*Primary Examiner* — Elmito Breval
(74) *Attorney, Agent, or Firm* — Muncy, Geissler, Olds & Lowe, P.C.

(57) ABSTRACT

An LED lighting device is provided, having a lamp housing and at least one LED module. The lamp housing has a lamp cover and a housing-type heat-dissipating lamp bracket that directly radiates the heat generated by the LED module. The housing-type heat-dissipating lamp bracket is entirely made of heat-dissipating material, and several radiating hole devices are set on the housing-type heat-dissipating lamp bracket. The radiating hole devices on the housing-type heat-dissipating lamp bracket and the gaps between the LED modules form a mutually-reinforcing thermal honeycomb effect, providing a heat dissipation channel with unhindered air convection. Radiating holes are set at the head and tail of the housing-type heat-dissipating lamp bracket. The radiating holes and the gaps between the modules enhance the heat-dissipating effect and enhance air convection, to
(Continued)

improve heat dissipation from the lamp housing and provide improved heat dissipation effect for the entire lamp.

15 Claims, 11 Drawing Sheets

(51) Int. Cl.

| | |
|---|---|
| ***F21V 21/116*** | (2006.01) |
| ***F21V 29/76*** | (2015.01) |
| ***F21V 29/70*** | (2015.01) |
| ***F21V 21/30*** | (2006.01) |
| ***F21V 29/83*** | (2015.01) |
| *F21W 131/103* | (2006.01) |
| *F21Y 113/00* | (2016.01) |
| *F21Y 115/10* | (2016.01) |

(52) U.S. Cl.
CPC ..... *F21V 29/76* (2015.01); *F21V 29/83* (2015.01); *F21V 29/763* (2015.01); *F21W 2131/103* (2013.01); *F21Y 2113/00* (2013.01); *F21Y 2115/10* (2016.08)

(56) References Cited

U.S. PATENT DOCUMENTS 8,256,919 B2 * 9/2012 Holder ..... F21V 29/70 257/79
8,376,582 B2 * 2/2013 Catone ..... F21S 8/086 362/249.03
8,641,234 B2 * 2/2014 Dube ..... F21S 8/086 362/240
2008/0068799 A1 * 3/2008 Chan ..... F21V 29/004 361/697
2009/0185374 A1 * 7/2009 Wu ..... F21S 8/086 362/249.06
2009/0310381 A1 * 12/2009 Chang ..... F21V 29/004 362/555
2011/0038153 A1 * 2/2011 Hu ..... F21S 8/086 362/249.02
2011/0063832 A1 * 3/2011 Hu ..... F21V 29/74 362/235
2011/0075433 A1 * 3/2011 Mart ..... F21V 29/225 362/427
2011/0205746 A1 * 8/2011 Lundin ..... H05B 41/02 362/373
2011/0235343 A1 * 9/2011 Arai ..... F21S 8/086 362/373
2012/0002413 A1 * 1/2012 Kim ..... F21S 2/005 362/235
2013/0188371 A1 * 7/2013 Ham, II ..... F21V 29/20 362/373
2014/0049961 A1 * 2/2014 Wilcox ..... F21V 5/04 362/244

FOREIGN PATENT DOCUMENTS

CN 201776563 U 3/2011
CN 201916806 U 8/2011
CN 201944672 U 8/2011
CN 202032394 U 11/2011
CN 202065804 U 12/2011
CN 202118617 U 1/2012
CN 202371521 U 8/2012
CN 202452239 U 9/2012
CN 202598182 U 12/2012

* cited by examiner

Enlargement of A

Enlargement of A

Enlargement of A

100

200

300

LED LIGHTING DEVICE

BACKGROUND OF THE INVENTION

Field of the Invention

The present invention relates to the LED lighting field, especially to a LED lighting device.

Brief Discussion of the Background Art

LED lighting devices have the advantages of energy conservation, long service life, good applicability, and rapid response, and are environmentally friendly, have bright and pure colors, and are the direction the lighting industry is taking for the future.

Existing LED lighting devices usually have an integrated structure, i.e., a LED light source is welded to a complete aluminum base plate and then fixed on a heat sink, and afterwards enclosed to a lamp housing. Taiwan publication number 101871605A discloses a type of LED street lamp which includes a contact, power supply module, and light source module. Through the internal and external ring gear structure, the lamp contact can be adjusted and fixed with a bolt in the positioning groove and power supply module. A light control module is set on the cover of the power supply module, which is fixed in the groove of the power supply cavity with its own fixation board and top connected to the light source module. The cover is connected and fixed with the power supply module main body through hinges and hooks. The light source module includes two supporting arms on the fixed power supply side wall, and several light source modules bridging between the two arms and on the supporting platform of the supporting arms. Another end of the supporting arm is fixed and integrated by the end cover. The LED street lamp is relatively enclosed with a compact module arrangement, and more installation components for fixation and supporting.

Therefore, integrated LED lights have the following disadvantages:

Firstly, integrated LED lights accumulate heat and convection is unrealizable in the enclosed lamp body. This makes LED lights having a high working temperature, fast light declination, and short service life. Also, there are no radiating holes at the head and the tail of the lamps, so that heat can be hardly dissipated. The relatively intense module arrangement leads to a poor dissipation effect. In particular, in the case of several modules, the dissipation effect of the modules in the middle will be rather disappointing.

Secondly, improper installation of lamp housing, and improper installation of lamp housing with LED will easily lead to dislocation and shaking, thereby affecting the utilization performance and the sealing of the complete lamp.

BRIEF SUMMARY OF THE INVENTION

The present invention provides an LED lighting device to resolve the existing technology problems concerning dissipation.

More specifically, the present provides an LED lighting device, comprising a lamp housing and at least one LED module, wherein the lamp housing includes a lamp cover and a housing-type heat-dissipating lamp bracket that directly radiate the heat generated by the LED module. The housing-type heat-dissipating lamp bracket is entirely made of heat-dissipating material, and several radiating hole devices are set at the head and/or tail of the lamp bracket. In the case with several LED modules, gaps remain among the LED modules. The radiating hole devices on the housing-type heat-dissipating lamp bracket and the gap between the LED modules form a mutually-reinforcing thermal honeycomb effect and in cooperation with the ventilation holes of the lamp cover, a heat dissipation channel with unhindered air convection is formed.

In comparison with the existing technology that adopts only the gaps between the modules to form a honeycomb thermal effect, the radiating holes on the modularized LED lighting device and the gaps between the modules interactively enhance the effect, accelerating air convection and facilitating heat dissipation from the lamp housing. This achieves a better heat dissipation effect for the entire lamp.

Preferably, the radiating hole devices include radiating holes and radiating holes setting with the chimney wall around. A large number of reinforcing ribs for increasing the dissipation area have also been set. Around the radiating holes where reinforcing ribs are not intense, a radiating hole chimney wall is set to facilitate the passage of hot air flow through the radiating holes.

Heat from the LED module is conducted to and dissipated through the heat sink. Also, heat can be conducted to the housing-type heat-dissipating lamp bracket through the groove structure on the heat sink and the protruding beam of the housing-type heat-dissipating lamp bracket, which further enhancing the heat dissipation effect. The radiating holes, chimney wall, and reinforcing ribs facilitate the dissipation and increase the total dissipation area.

Preferably, several supporting members are set on the housing-type heat-dissipating lamp bracket, and mating members are set in corresponding positions of the lamp cover. When the LED lighting device is in a closed state, the supporting members are connected with the corresponding mating members for fixation.

Preferably, the housing-type heat-dissipating lamp bracket and the lamp cover are connected through the supporting members with gaps remaining therebetween. Gaps also remain between two adjacent modules, and between modules and the lamp cover. A thermal honeycomb effect formed by the radiating hole device on the housing-type heat-dissipating lamp bracket and the gap between the LED modules, together with the ventilation hole on the lamp cover and the gap between the lamp cover and the housing-type heat-dissipating lamp bracket, form a dissipating channel with unhindered air convection.

Preferably, a positioning notch is set on the heat sink and corresponding screw holes are set on the housing-type heat-dissipating lamp bracket. Passing through the positioning notch and the screw hole, a hand screw fixes the heat sink and the housing-type heat-dissipating lamp bracket.

Preferably, a connection structure is set at the tail of the housing-type heat-dissipating lamp bracket. The connection structure is cast together with the housing-type heat-dissipating lamp bracket. In addition, a threaded hole is set on the connection structure to coordinate with a pressing plate.

Preferably, the heat sink can be cut from aluminum alloy sections. At the fitting place of the heat sink and lens assembly, a solid silicone ring is set. Also, liquid silicone is pasted at the sides of the solid silicone ring. At the outlet hole of the waterproof wire at the back of the LED module, a wedge silicone ring and metal nut are adopted for fixation.

Preferably, the lamp cover is molded by plastic injection or cast with aluminum. One side of the lamp cover is connected to the housing-type heat-dissipating lamp bracket through several hinges.

Preferably, at least one protruding beam is set on the housing-type heat-dissipating lamp bracket. The LED module includes a lens assembly, a PCB board, an LED light source module, and a heat sink. The LED light source module and the heat sink are placed respectively at the two sides of the PCB board. Also, a groove structure matching the protruding beam is formed on the heat sink. The protruding beam can be set in or removed out from the groove structure. When the protruding beam is set in, it is tightly fitted with the groove structure. In the case with several LED modules being set, the radiating channel also includes gaps which remain between the LED modules.

Preferably, on the housing-type heat-dissipating lamp bracket, a power supply holder and a mounting bracket are set. The power supply is set on the beam of the power supply holder. Standing legs set on two sides of the mounting bracket are installed on the standing legs of the two sides of the power supply holder.

Compared with existing technologies, the present invention includes the following advantages:

1) The present invention provides a favorable dissipation effect.

Firstly, the original entire heat sink is divided into several modules, among which gaps are reserved. The housing-type heat-dissipating lamp bracket, originally functioning only for support, is adopted to assist the heat sink in dissipating the heat generated by the modules. The surface area of the housing-type heat-dissipating lamp bracket has been fully utilized. A large number of radiating holes are set at the head and tail of the housing-type heat-dissipating lamp bracket. Also, ventilation holes are set on the lamp cover. The radiating holes on the housing-type heat-dissipating lamp bracket and the ventilations holes on the lamp cover form air convection and render a honeycomb thermal effect which facilitates air convection which fully passes the gaps among the modules and the radiating holes on the housing-type heat-dissipating lamp bracket, thereby rapidly dissipating heat. In addition, the ventilation holes on the lamp cover and the gaps between the lamp cover and the housing-type heat-dissipating lamp bracket allow air convection to smoothly and effectively dissipate the heat generated within the lamp housing, thereby providing an excellent dissipation effect. In the other words, radiating holes are set on the housing-type heat-dissipating lamp bracket and ventilation holes are set on the lamp cover which, together with gaps among the LED modules and the gap formed between the lamp cover and the housing-type heat-dissipating lamp bracket, create an air passage through which air convection in the entire lamp occurs efficiently and the heat generated within the lamp housing is effectively dissipated.

Compared with the existing technology that adopts only the gaps between the modules to form a honeycomb thermal effect, the radiating holes on the modularized LED lighting device and the gap between the modules of the present invention interactively enhance the effect, thereby accelerating air convection and facilitating heat dissipation from the lamp housing, and achieving a better heat dissipation effect of the entire lamp.

Secondly, heat from the LED module can be dissipated through the heat sink, as well as through the housing-type heat-dissipating lamp bracket to which the heat is conducted through the groove structure on the heat sink and the protruding beam on the housing-type heat-dissipating lamp bracket, thereby enhancing the dissipation effect.

2) The present invention has fewer components, is easy to assemble and maintain, and has low cost.

With fewer components, the entire lamp is composed of a cast housing-type heat-dissipating lamp bracket and lamp cover which are connected through an articulated adapting piece. Opening and closing of the lamp cover are easy. The installation fixation structure is designed on the die pressed casting. The LED module is installed into the lamp housing through a slot structure and fixed by a hand screw. The lamp cover and the housing-type heat-dissipating lamp bracket are also fixed through a hand screw. Therefore, tedious processes like turning screws are not required during installation and maintenance. The LED module can be disassembled and replaced without any tools.

3) The present invention provides a good sealing effect of the entire lamp.

The large-area entire sealing of the complete lamp is divided into several small LED modules which are connected with each other through waterproof wires, thereby improving sealing performance of the LED modules and sealing performance of the complete lamp. In addition, when compared with a complete lamp, due to the short perimeter of the sealing ring of the LED module, the sealing effect can be more easily achieved.

At the fitting place of the heat sink and lens assembly, a solid silicone ring is set and liquid silicone is pasted for dual-layer protection at the sides of the solid silicone ring. At the outlet hole of the waterproof wire at the back of the LED module, a wedge silicone ring and metal nut are adopted for fixation. In this way, a high protection level of the LED module and the sealing effect of the complete lamp are realized.

4) An external power supply improves safety of the complete lamp, which facilitates heat dissipation of the power supply during its operation and thus ensures its normal work and facilitates power supply replacement.

5) The supporting members, respectively set on the housing-type heat-dissipating lamp bracket and the lamp cover, are meshed for fixation, thereby avoiding sliding of the supporting members. Moreover the setting of the supporting members forms the gap between the housing-type heat-dissipating lamp bracket and the lamp cover.

DETAILED DESCRIPTION OF THE PREFERRED EMBODIMENTS

Figure 1:
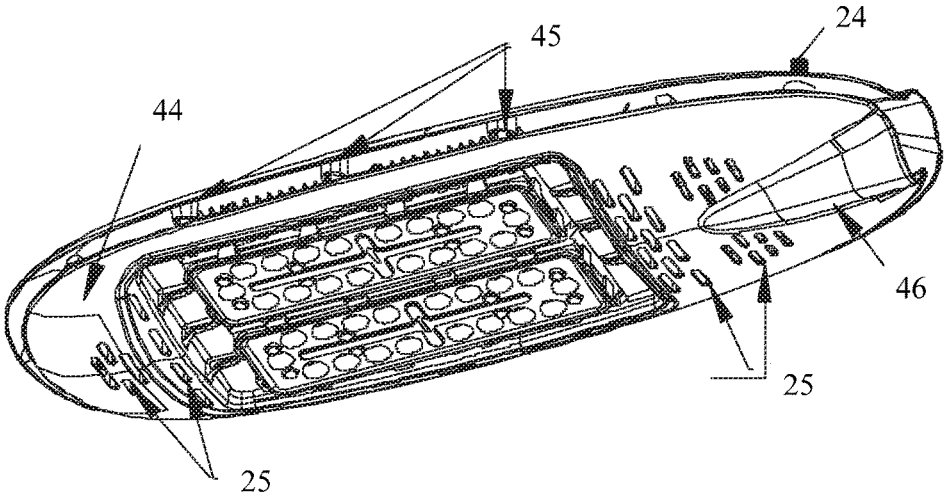
FIG. 1 is an overall structure drawing of Embodiment 1 of Application 1.
Figure 2:
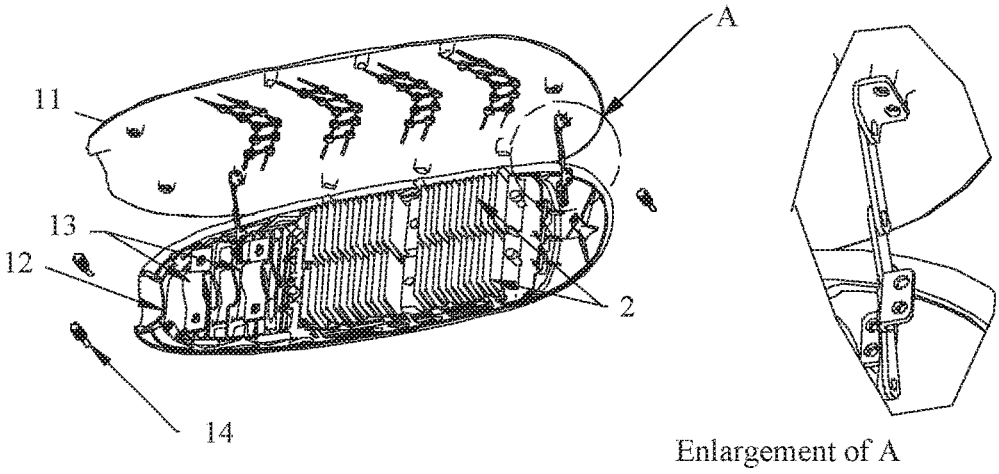
FIG. 2 is an overall structure drawing of the LED lighting device when the lamp cover is opened in Embodiment 1 of Application 1.
Figure 3:
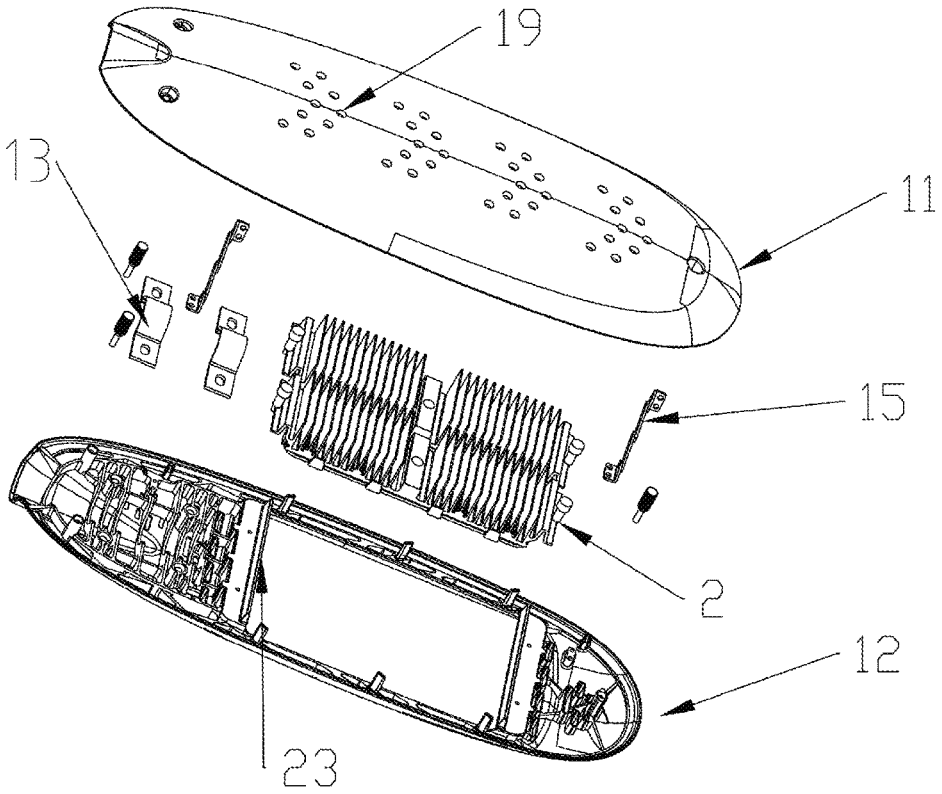
FIG. 3 is an exploded view of Embodiment 1 of Application 1.
Figure 4:
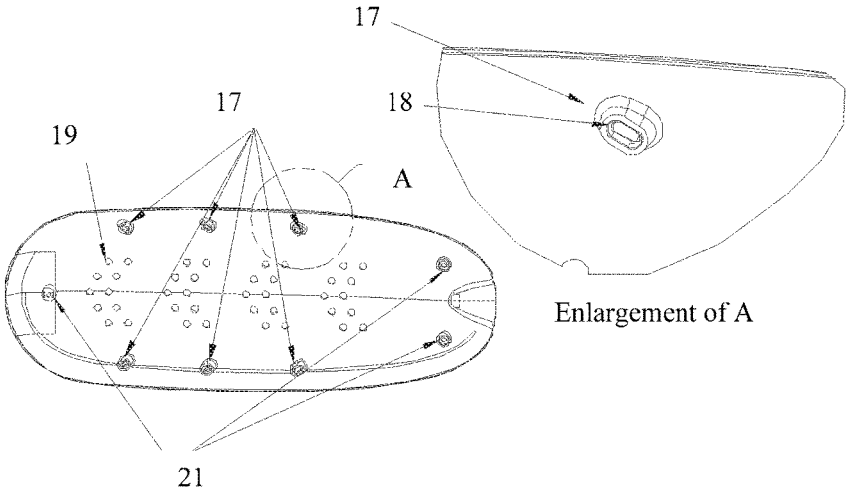
FIG. 4 is a sketch map of the lamp cover in Embodiment 1 of Application 1.
Figure 5:
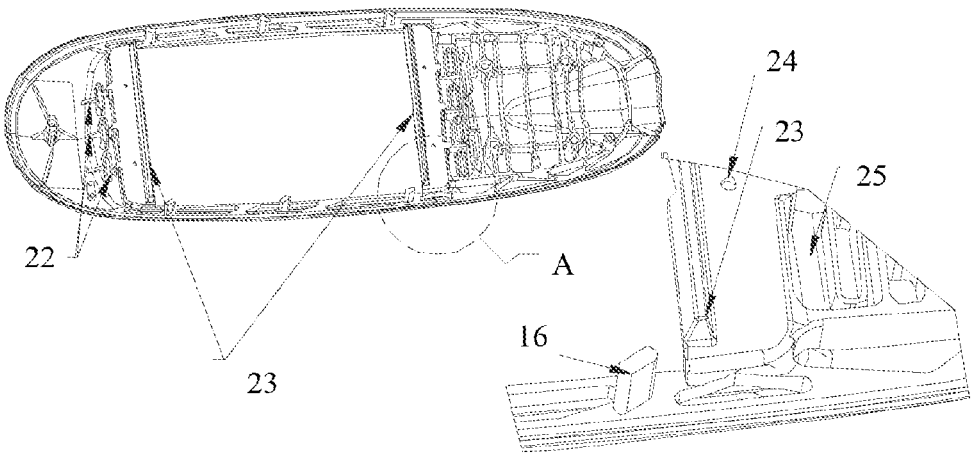
FIG. 5 is a sketch map of the hell-type radiating lamp holder in Embodiment 1 of Application 1.
Figure 6:
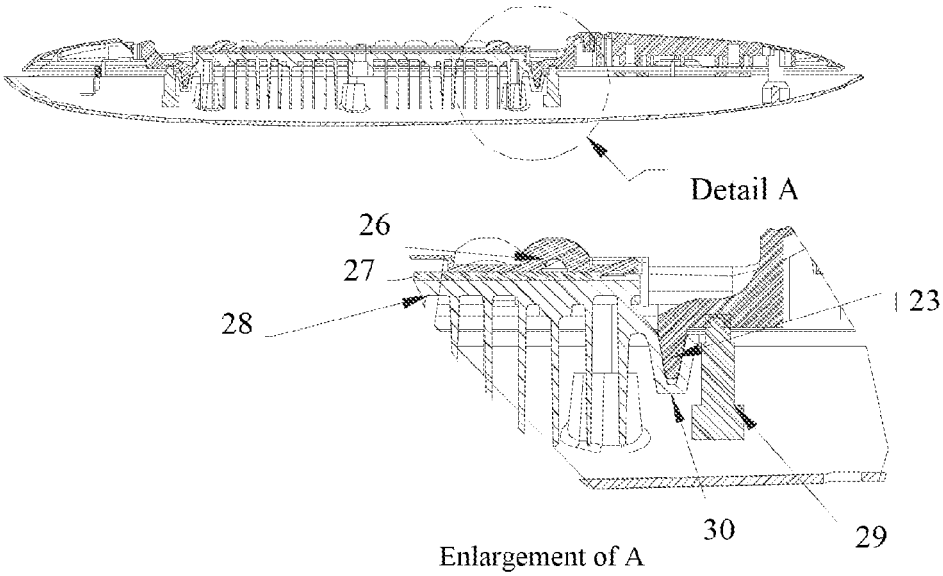
FIG. 6 is an overall sectional drawing of Embodiment 1 of Application 1.
Figure 7A:
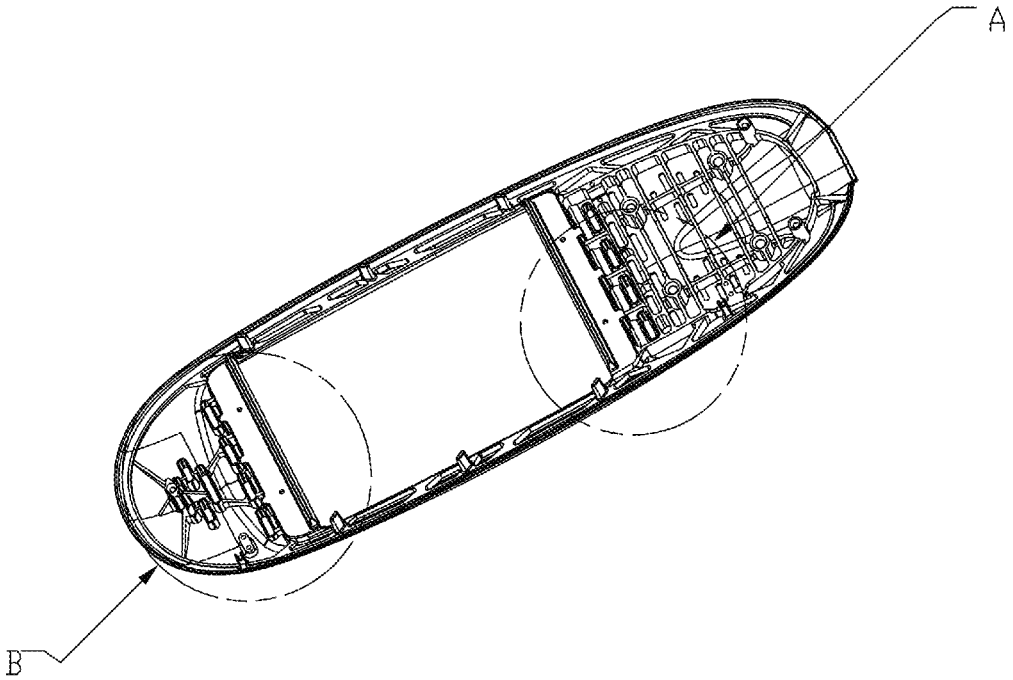
FIG. 7A-FIG. 7C are, respectively, an overall structural drawing of Embodiment 1 of Application 1, an enlarged drawing of part A, and an enlarged drawing of part B.
Figure 7B:
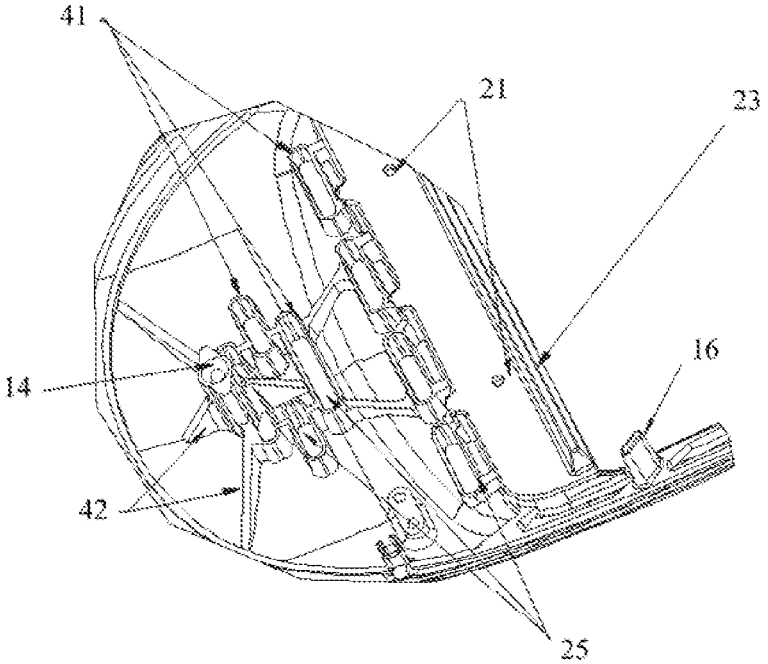
Figure 7C:
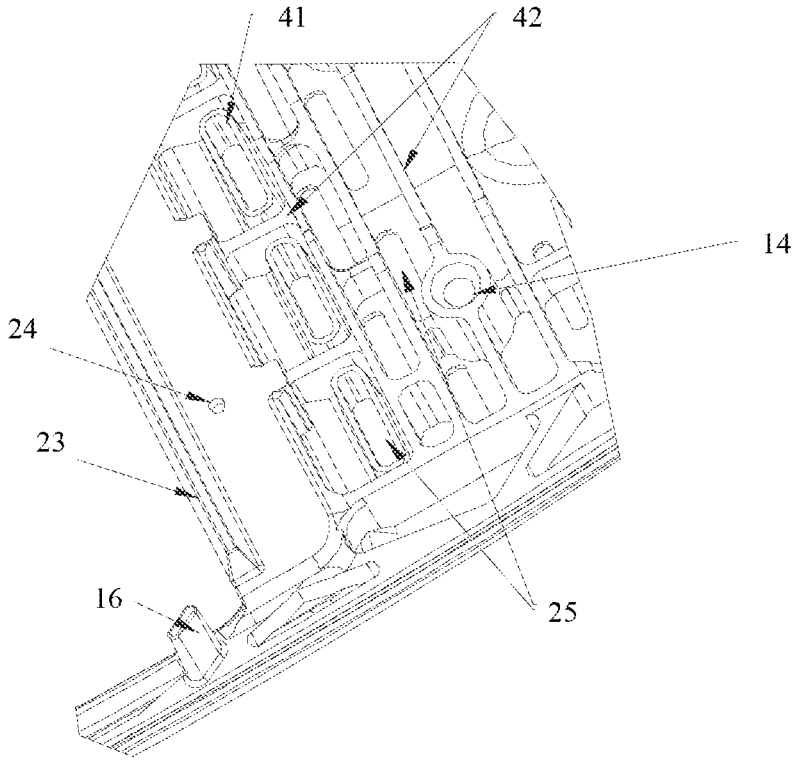

Hereby by combining the attached illustrations, the present invention is introduced in detail.

Application 1

Embodiment 1

FIGS. 1-7 illustrate an LED lighting device that includes a lamp cover 11, a complete lamp housing composed of a housing-type heat-dissipating lamp bracket 12 and at least one LED module 2. The LED module 2 can be installed to fit with a protruding beam 23 through the groove structure 30 on the housing-type heat-dissipating lamp bracket 12. A hand screw 29 is then used to lock and fix the LED module 2 and a complete LED lighting device is formed. The present invention is introduced in detail as below.

In the lamp, the original entire heat sink is divided into several modules. A large number of radiating holes 25 are set at the head 44 and the tail 46 of the housing-type heat-dissipating lamp bracket 12. The gap between the modules 2 and the radiating holes 25 function as a hot air flow channel, and the honeycomb thermal effect is utilized for rapid heat dissipation. Interactive enhancement between the radiating holes 25 and the gaps of separate modules 2 can intensify air convection. Based on different dissipation requirements, the lamp cover 11 and the housing-type heat-dissipating lamp bracket 12 may be closed or opened with a gap remaining therebetween. The gap between the radiating hole on the housing-type heat-dissipating lamp bracket and the lamp cover housing-type heat-dissipating lamp bracket can also form dissipation channel having smooth air convection.

The housing-type heat-dissipating lamp bracket can be cast from high-strength materials. At the head 44 and the tail 46 of the housing-type heat-dissipating lamp bracket, several arrays of radiating holes 25 are set along the direction of the protruding beam to the two ends, as well as a large number of reinforcing ribs 42. Around the radiating holes 25 with non-intensive reinforcing ribs 42, a radiating hole chimney wall 41 is set. Part of the reinforcing ribs 42 can directly extend and form a radiating hole chimney wall 41, such as the dissipating chimney wall 41 of the radiating hole 14. The setting of the radiating hole chimney wall 41 facilitates hot air flow to pass through the radiating holes, thereby forming a honeycomb thermal effect. The radiating hole chimney wall 41 and reinforcing rib 42 facilitate heat dissipation and increase the total heat dissipation area. A gap remains between the LED module 2 and the modules. The interaction between the gaps among the modules and the radiating holes can enhance air convection, thereby facilitating effective dissipation of heat generated within the lamp housing.

The housing-type heat-dissipating lamp bracket 12 can be cast from high-strength materials. At the tail of the housing-type heat-dissipating lamp bracket 12, a connection structure is set, which can either be cast together with the housing-type heat-dissipating lamp bracket 12 or be set separately and fixed. For the housing-type heat-dissipating lamp bracket 12, a threaded hole can be set on the connection structure to cooperate with the press board 13 for connecting the complete lamp and the lamp pole.

One or several protruding beams 23 can be set within the housing-type heat-dissipating lamp bracket 12. Direction of the protruding beam 23 is in consistent with the arrangement direction of the LED module 2 to facilitate fixation. The protruding beam 23 is a long strip to facilitate the ends thereof being fixed on the two sides of the housing-type heat-dissipating lamp bracket 12. A cross section of the protruding beam 23 can be various shapes including oval shape, square shape etc. The cross section of the protruding beam is fitted with the groove structure cast from aluminum section on the LED module 2. In particular, the protruding beam 23 can be set in or removed out of the groove structure 30 for detachable connection. Moreover, when it is set in, the protruding beam 23 and the groove structure 30 are tightly fit. The housing-type heat-dissipating lamp bracket 12 and the protruding beam 23 are made of metal materials or dissipating materials, including graphite. Thus, when the protruding beam 23 is set in, the heat generated from the LED module 2 can pass through the protruding beam 23 and be dissipated directly through the housing-type heat-dissipating lamp bracket 12.

Several supporting members 16 are set around the periphery of the housing-type heat-dissipating lamp bracket 12, and mating members 17 are set in corresponding positions to the periphery of the lamp cover 11. When the LED lighting device is in a closed state, the supporting members 16 and the corresponding mating members 17 are fixed. The mode of setting stabilizes the entire shell of the LED lighting device, making it harder to deform or dislocate. In the embodiment, the mating member is an oval groove 18, and the supporting members are elliptic cylinders. When the LED lighting device is in a closed state, the oval groove 18 and the elliptic cylinders are meshed and fixed. The cooperation of the supporting members 16 with the corresponding mating members 17 stabilizes the lamp cover in its closed state, making it hard to dislocate or shake loose.

In addition, opening and closing of the lamp cover is realized through the hinge joint of the lamp cover 11 and the housing-type heat-dissipating lamp bracket 12 by an adapting piece. In the embodiment, the hinge 15 is adopted for connection, making the opening and closing more convenient. The angle of the opening of the side of the lamp cover can be adjusted by changing the length of the hinge 15.

Moreover, when the lamp cover 11 is in a closed state, a gap between it and the housing-type heat-dissipating lamp bracket 12 is reserved, making air flow smoothly and providing a better heat dissipation performance. Gaps are reserved among the LED modules 2 and between the lamp cover 11 and the housing-type heat-dissipating lamp bracket 12 to form an air channel, thereby facilitating effective heat dissipation from the lamp housing. In particular, at the head and the tail of the housing-type heat-dissipating lamp bracket 12, several radiating holes 25 are set to enhance air convection. On the lamp cover 11, a ventilation hole 19 is set to enhance heat dissipation effect. Also, by modifying the form and arrangement of the ventilation holes, the lamp can be beautified.

The neck structure 30 formed from aluminum section in the LED module 2 is fitted. In addition, the screw hole 24 on the housing-type heat-dissipating lamp bracket 12 is fitted with the positioning notch on the LED module 2 to determine the relative position of the LED module 2. The LED module 2 is locked and fixed through a hand screw, which makes assembly and disassembly of the LED module convenient and easy to maintain.

The lamp cover 11 can be formed by plastic injection or cast with aluminum. One side thereof is connected through two hinges 15 to the housing-type heat-dissipating lamp bracket 12. When installation of the LED module 2 and lamp pole is finished, the lamp cover 11 is closed and a hand screw 14 is used to tightly lock the lamp cover 11 and the housing-type heat-dissipating lamp bracket 12. The number of the complete lamp components is fewer. One side of the lamp cover 11 is connected to the housing-type heat-dissipating lamp bracket 12 through two hinges 15, and the module 2 is fixed through the hand screw on the protruding beam of the housing-type heat-dissipating lamp bracket. The lamp pole is fixed with the press board on the tail of the housing-type heat-dissipating lamp bracket. The lamp cover is closed and then tightened with the hand screw. The installation is convenient and highly efficient. Maintenance without any tools is possible. One may loosen the hand screw by hand to replace the module.

The LED module 2 usually includes a heat sink 28, a PCB board 27 and a lens assembly 26. The heat sink 28 can be cut from aluminum alloy section. A corresponding groove structure formed on the heat sink 28 is fitted with and installed on the protruding beam 23 on the housing-type heat-dissipating lamp bracket 12. The hand screw 29 is used to complete the horizontal positioning of the LED module 2 through the screw hole 24 on the housing-type heat-dissipating lamp bracket 12 and the notch processed on the heat sink 28. A solid silicone ring is set at the fitting place of the heat sink 28 and the lens assembly 26, and liquid silicone is pasted for dual-layer protection at the sides of the solid silicone ring. At the outlet hole of the waterproof wire at the back of the LED module 2, a wedge silicone ring and metal nut are adopted for fixation. In this way, a high protection level of the LED module and the sealing effect of the complete lamp are realized.

Different LED modules 2 are connected through waterproof wires. The external power supply of which the electric wire is led out through the lamp pole can improve security of the project lamp, facilitating heat dissipation of working power supply to ensure normal work of the power supply, and facilitating power supply replacement.

Embodiment 2

Figure 8:
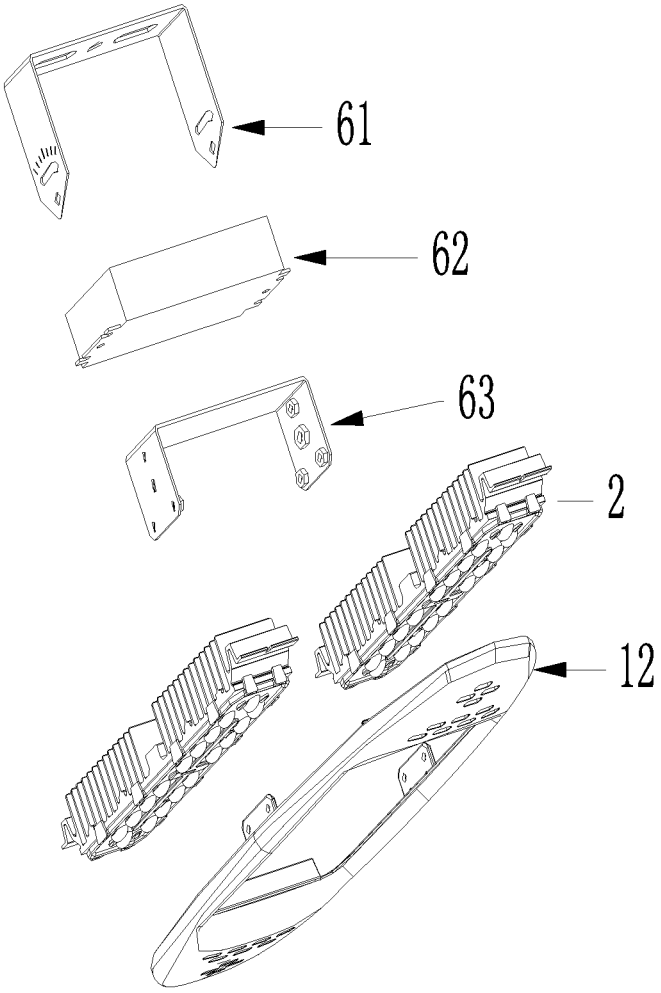
FIG. 8 is an exploded view of Embodiment 2 of Application 1.
Figure 9:
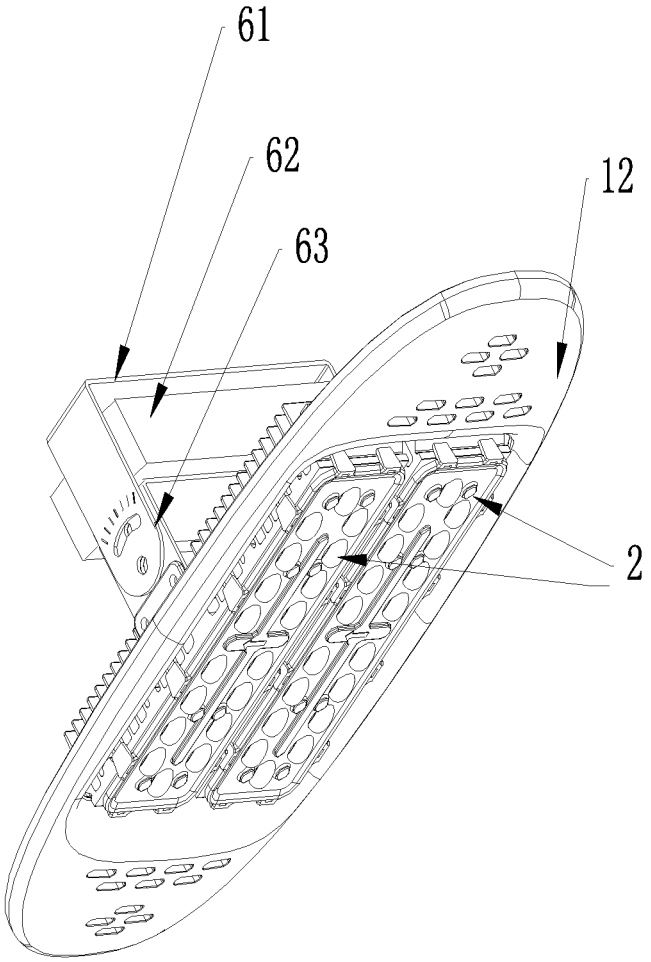
FIG. 9 is a structural sketch drawing of Embodiment 2 of Application 1.
Figure 10:
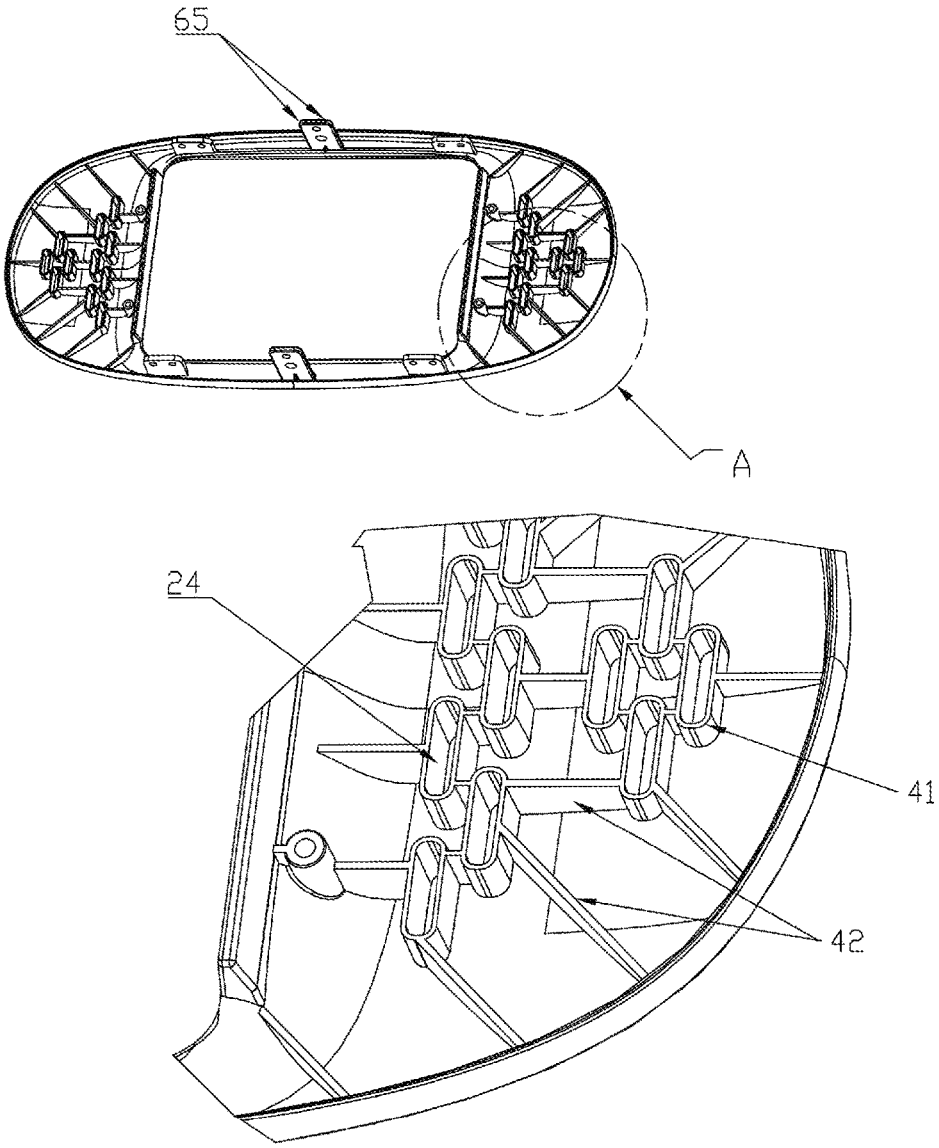
FIG. 10 is a structural sketch drawing of a housing-type heat-dissipating lamp bracket of Embodiment 2 of Application 1.

As shown in FIGS. 8-10, the second embodiment is a type of tunnel lamp or factories and mines lamp, which can be applied to different places including tunnels, workshops, large warehouses, gas stations, venues, metallurgy and other factories and construction sites based on its various installations.

There are several differences between this embodiment and Embodiment 1. (1) The lamp cover 11 in the Embodiment 1 is removed. The lamp cover 11 can be removed based on different applications. (2) On the housing-type heat-dissipating lamp bracket 12, a fixed threaded hole 65 for the power supply holder 63 is set, the power supply holder 63 is fixed on the housing-type heat-dissipating lamp bracket through the threaded hole 65. The power supply holder 63 is of n-shape structure, and the power supply 62 is fixed on the beam of the power supply holder 63 through a bolt. The mounting bracket 61 is also of n-shape structure with the supporting legs of the two sides installed on the supporting legs of the power supply holder 63 through the bolt. Meanwhile, the beam of the mounting bracket 61 is above the power supply 62, which is installed together with the lamp body for convenient utilization. The power supply 62 is installed on the power supply holder 63 and not fit the housing-type heat-dissipating lamp bracket 12, thereby facilitating heat dissipation of working power supply, ensuring normal operation of the power supply 62, and making replacement thereof convenient. Other parts of this embodiment are the same with the Embodiment 1. Therefore, no repetition is given here.

Application 2

Figure 11:
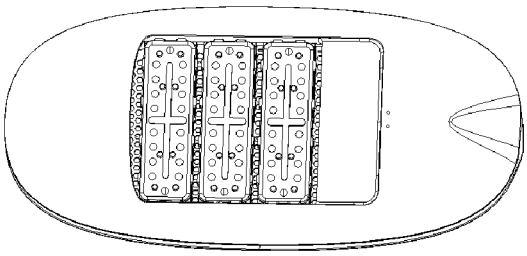
FIG. 11 is an overall drawing of one Embodiment of Application 2.
Figure 12:
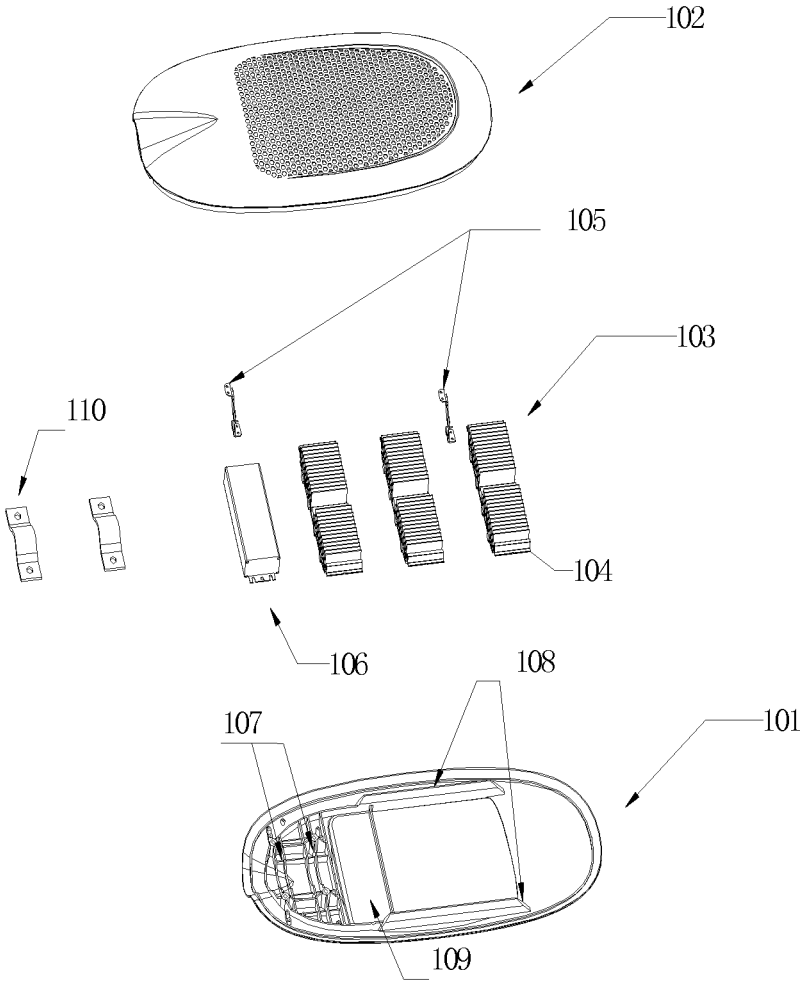
FIG. 12 is an exploded view of one Embodiment of Application 2.

With reference to FIGS. 11 and 12, these figures illustrate an LED lighting device 100 which includes the entire lamp housing composed of an upper lamp housing 102, a lower lamp housing 101, an LED module 103, and a power supply 106.

The LED module 103 is composed of a heat sink, a circuit board, and an LED lens. The heat sink is made of thermal-conductive materials. The two ends of the heat sink are wedge groove structures 104 with positioning notches set at its ends. Through the positioning notches, a screw is used to fit the LED module 103 tightly on a protruding beam 108 of the lower lamp housing 103.

The lower lamp housing 101 is cast from high-strength materials. At the module installation position, the protruding beam 108 and convex platforms to install screws are set. The convex platforms are set with certain intervals to ensure that gaps remain among the LED modules. The convex platforms, cooperating with the positioning notches at the two ends of the LED module 103, are used for installing the LED module 103. At the internal tail of the lower lamp housing 101, reinforcing ribs are set to increase the structural strength of the lamp housing. At the end of the lower lamp housing 101, a lamp pole supporting part 107 is set, which can be cast together with the lower lamp housing 101. A threaded hole is set on the lamp pole supporting part of the lower lamp housing 101 to cooperate with a connecting fastener 110 to connect the entire lamp and the lamp pole. At the end of the lower lamp housing 101, a power supply fixation position is set. In the power supply fixation position, a fixed platform 109 is set, which is convex toward the internal lamp housing and has a smooth surface. The power supply 106 fits tightly with the fixed platform 109 for heat dissipation of the power supply. Also, a water leakage hole is set near the fixed platform to drain accumulated water over time. The two ends of the power supply 106 are fixed through installation elements. On the entire side surface of the lower lamp housing 101, ventilation holes are set. The ventilation holes can be set directly on the surface of the lower lamp housing (or the upper lamp housing) evenly, or in a size and density determined according to the dissipation of the lamp housing.

The upper lamp housing 102 can be formed by plastic injection or cast with aluminum. Radiating holes are set on the position corresponding to the module and power supply 106. On one side of the upper lamp housing 102, a buckle structure or thread structure is set, through which the upper lamp housing 102 and the lower lamp housing 101 are locked tightly. On the other side of the upper lamp housing 102, hinges are set to make the upper lamp housing 102 turn freely.

The radiating holes on the upper lamp housing 102, gaps among the LED modules 103, and ventilation holes on the side of the lower lamp housing 101 form a smooth heat-dissipation channel.

In the above structure, the radiating holes on the upper lamp housing 102, gaps among the LED modules 103, and the ventilation holes on the side of the lower lamp housing 101 form a smooth heat dissipation channel, providing a good dissipation effect. In addition, the interior power supply in the lamp housing beautifies the entire lamp. Near the power supply, a water leakage hole is set to drain the accumulated water over time, and thus protect the power supply.

Application 3

Figure 13:
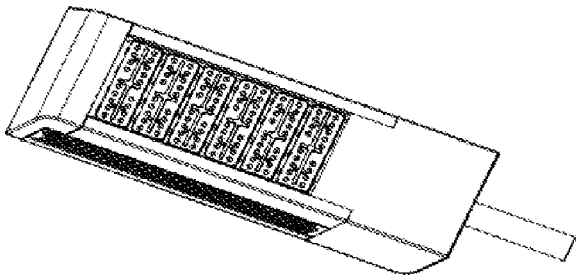
FIG. 13 is an overall drawing of one Embodiment of Application 3.
Figure 14:
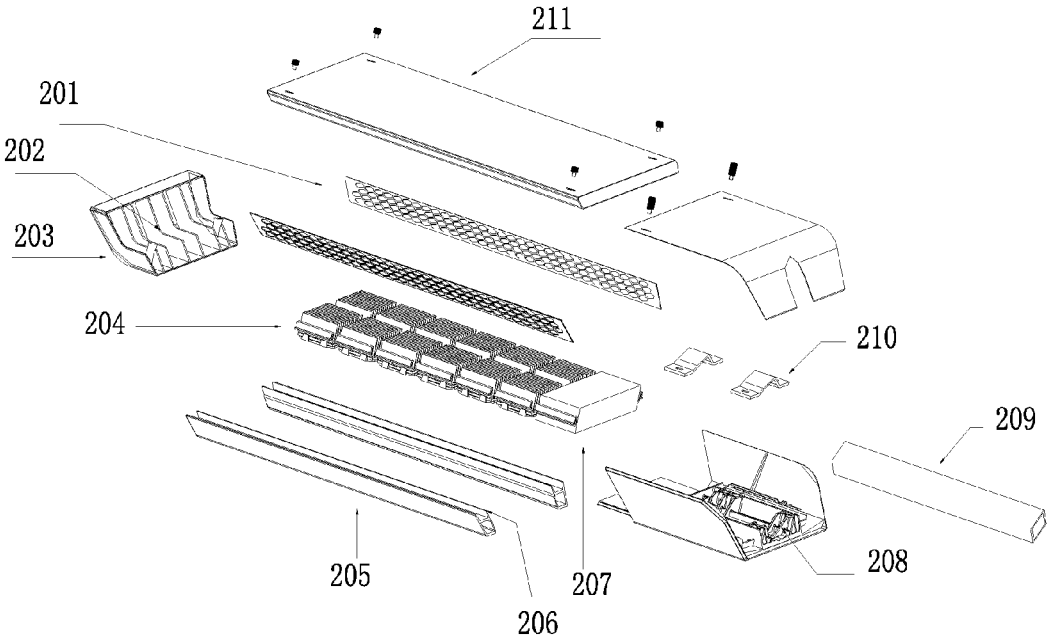
FIG. 14 is an exploded view of one Embodiment of Application 3.

With reference to FIGS. 13 and 14, these figures illustrate an LED lighting device 200 which comprises a lamp housing, an LED module 204, and a power supply 207.

The lamp housing includes a head assembly 203, a tail assembly, a side frame assembly, and a lamp cover 211. The side frame assembly includes a side frame base 205 and a mesh-type side wall 201 which is connected to the external surface of the side frame base 205 to form a side wall of the lamp housing. Within the side frame base 205, a protruding beam 206 is set for installing an LED module. The two ends of the side frame assembly are connected separately to the head assembly 203 and the tail assembly. A reinforcing rib 202 is set on the head assembly 203. A power supply installation position and a lamp pole supporting part are set on the tail assembly. A screw positioning hole is set at the power supply installation position. A screw positioning hole is also set at the lamp pole supporting part to cooperate with a compression bar metal plate 210 to connect the complete lamp to the lamp pole 209. A reinforcing rib is set within the tail assembly. A screw hole is set on the lamp cover 211, which matches the screw positioning hole on the head assembly and the tail assembly of the lamp housing and fixes the lamp cover 211 with the screws.

The two ends of the LED module 204 are designed in a wedge groove structure which is tightly connected with the protruding beam 206 on the internal side of the side frame base 205. The heat generated from the LED module 204 is transferred to the protruding beam 296 on the lamp housing through the wedge groove and then to the entire lamp holder. At the two ends of the LED module 204, a positioning notch is also set, through which a screw fixes the LED module 204 to the lamp housing. In the case of several LED modules 204 installed within the LED lighting device, gaps are reserved among the LED modules 204. The gaps between the modules, together with the mesh-type side wall 201 of the lamp housing, form a smooth heat-dissipation channel.

The side wall of the lamp housing in the present invention has a net structure made of meshes. The size and density of the meshes are determined as per dissipation requirements. When the side wall of the lamp housing is cooperated with the gaps among the LED modules, there are no isolating parts in the middle, thereby making the heat dissipation channel smooth and rendering a better heat dissipation effect.

Application 4

Figure 15:
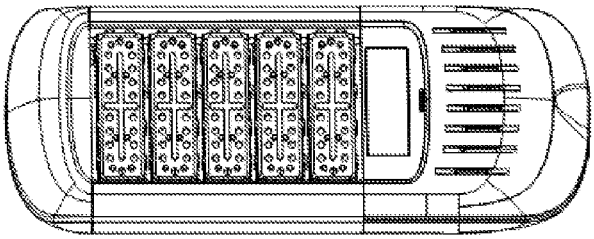
FIG. 15 is an overall drawing of one Embodiment of Application 4.
Figure 16:
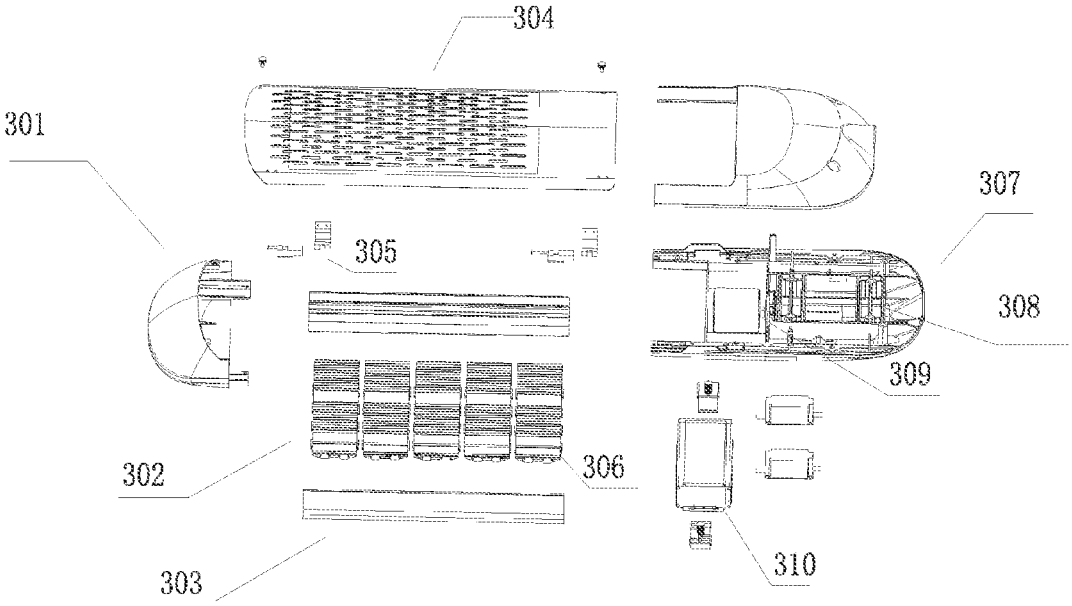
FIG. 16 is an exploded view of one Embodiment of Application 5.

With reference to FIGS. 15 and 16, these figures illustrate an LED lighting device 300 which comprises a complete lamp housing composed of a lamp cover 304 and a housing-type heat-dissipating lamp bracket, a power supply, and at least one LED module 302.

The lamp cover 304 and the housing-type heat-dissipating lamp bracket form the lamp housing of the LED lighting device. The lamp housing can be cast with high-strength materials. The housing-type heat-dissipating lamp bracket includes a side frame assembly 303, a head assembly 301, and a tail assembly 307, which are connected together to form an integral part. On the front surface of the head assembly of the housing-type heat-dissipating lamp bracket, the front surface of the tail assembly, the lamp cover, and arrays of radiating holes are set, as well as a large number of reinforcing ribs and multiple radiating hole chimney walls. The radiating hole chimney walls and the reinforcing ribs facilitate heat dissipation and increase the total dissipation area. If several LED modules 302 are set, gaps remain among the LED modules. The gaps among the LED modules, the radiating hole devices on the housing-type heat-dissipating lamp bracket, and the radiating holes on the lamp cover 304 interact together, in order to enhance air convection and facilitate effective heat dissipation from the lamp housing.

On the tail assembly of the housing-type heat-dissipating lamp bracket, two lamp pole supporting parts for connecting the lamp pole are set with certain distance between the two lamp pole supporting parts, so as to prevent overload of the lamp pole support part that could lead to deformation of the lamp housing. The lamp pole supporting parts can be cast together with the housing-type heat-dissipating lamp bracket, or separately set and fixed. For the housing-type heat-dissipating lamp bracket, a threaded hole can be set on the lamp pole support part to cooperate with a press board to connect the entire lamp and the lamp pole. On the tail assembly of the housing-type heat-dissipating lamp bracket, a power supply installation position is set with a convex structure. The power supply and the convex structure are tightly fitted for effectively transferring the heat generated by the power supply. Also, besides the convex structure, a water leakage hole 309 is set to prevent rainwater accumulation that could affect performance of the power supply.

On the internal side of the side frame assembly of the housing-type heat-dissipating lamp bracket, protruding beams are set. At the two ends of the heat sink of the LED module, a wedge groove 306 structure is set. The LED module is installed to fit the protruding beams of the housing-type heat-dissipating lamp bracket through the wedge groove 306 structure, and then screws are used to lock and fix the LED module 302. The wedge groove structure of the LED module 302 fits tightly with the protruding beams on the housing-type heat-dissipating lamp bracket. Heat generated from the LED module can pass through the protruding beam and be dissipated directly through the housing-type heat-dissipating lamp bracket.

On the internal sides of the head assembly and the tail assembly of the housing-type heat-dissipating lamp bracket, several supporting members are set. On the corresponding positions of the lamp cover, mating members are set. When the LED lighting device is in a closed state, the supporting members are adapted and stabilized to the mating members, thereby making the entire shell of the LED lighting device fixed without easy deformation or dislocation thereof. When the LED lighting device is in a closed state, the supporting members and the corresponding mating members are meshed and fixed to prevent dislocation and shaking thereof.

The lamp cover can be formed by plastic injection or cast with aluminum. One side of the lamp cover is connected to a housing-type heat-dissipating lamp bracket through two hinges, making the lamp cover freely opened and closed along the side frame assembly 305. The module is fixed on the protruding beam of the housing-type heat-dissipating lamp bracket through hand screws. A press plate is used to fix the lamp pole on the tail of the housing-type heat-dissipating lamp bracket. When the LED module and lamp pole are installed, the lamp cover is closed and the lamp cover and housing-type heat-dissipating lamp bracket are locked through hand screws. The lamp is convenient and highly efficient to install. It can be disassembled and replaced without any tools, i.e., the hand screws can be disassembled by hand to change the LED module.

The wedge groove cast from aluminum section on the LED module matches the protruding beam on the housing-type heat-dissipating lamp bracket. The screw holes on the housing-type heat-dissipating lamp bracket match the positioning notch on the LED module to determine the relative position of the LED module, and the LED module is locked through hand screws. This makes assembly and disassembly of the LED easy and convenient to maintain.

The LED module usually includes a heat sink, a circuit board, and a lens assembly. The heat sink can be cut from an aluminum alloy section. Corresponding groove structures are cast on the heat sink to be installed on the protruding beams of the housing-type heat-dissipating lamp bracket, and a hand screw is used to complete the horizontal positioning of the LED module through screw holes on the housing-type heat-dissipating lamp bracket and a positioning notch on the heat sink. At the fitting place of the heat sink and lens assembly, a solid silicone ring is set and, at the sides of the solid silicone ring, liquid silicone is pasted for dual-layer protection. At the outlet hole of the waterproof wire at the back of the LED module, a wedge silicone ring and a metal nut are adopted for fixation. In this way, a high protection level of the LED module and the sealing effect of the complete lamp are achieved.

The foregoing applications all boast the following advantages:

(1) On the head and/or tail of the lamp housing, several radiating hole devices are set. The radiating hole devices and the gaps between the LED modules form a mutually-reinforcing thermal honeycomb effect and, together with the side walls of the lamp housing, form a heat dissipation channel with smooth air convection. Alternatively, radiating hole devices are set at the two side walls of the lamp housing, and the radiating hole devices at the two side walls together with the gaps among the LED modules form a heat dissipation channel having smooth air convection.

(2) The LED module includes at least a heat sink, a circuit board, and an LED lens unit. The two ends of the heat sink have a wedge groove structure. At the end of the wedge groove, a positioning notch is set, through which the LED module is fixed on the protruding beam at the corresponding position of the lamp housing. At the corresponding position of the protruding beam, convex platforms are set for installing screws. Heat of the LED module is transferred to the protruding beam through the wedge groove, thereby forming a heat dissipation channel. The number of the protruding beams can be one or more. The direction of the protruding beams is in consistent with the arrangement direction of the LED module for fixation. The protruding beam is a long strip to facilitate the ends thereof being fixed on the two sides of the housing-type heat-dissipating lamp bracket. A cross section of the protruding beam can be various shapes, including an oval shape, a square shape, etc. The cross section of the protruding beam fit with the groove structure cast from aluminum section on the LED module, and the protruding beam can be set in or removed out of the groove structure. When it is set in, the protruding beam and the groove structure are fit tightly with each other. The housing-type heat-dissipating lamp bracket and the protruding beam are made of metal materials or heat-dissipating materials including graphite. Thus, when it is set in, the heat generated from the LED module can pass through the protruding beam and be dissipated directly through the housing-type heat-dissipating lamp bracket.

The optimal embodiments of the present invention disclosed hereby only serve to illustrate the invention. The optimal embodiments have not introduced all details, and shall not be regarded as the only embodiments of the present invention. Obviously, in accordance with the description, revisions can be made. The description selects and describes these embodiments for better explaining the principles and practical applications of the present invention, and thus enabling better utilization of the prevent invention by technicians of the field. The description is only limited to the claims, its full scope and equivalents.

The invention claimed is:

1. An LED lighting device, comprising:

a lamp housing; and at least one LED module, the at least one LED module comprising an elongate protruding beam, wherein the lamp housing comprises:

a lamp cover;

a housing-type heat-dissipating lamp bracket that directly radiates the heat generated by the LED module, the housing-type heat-dissipating lamp bracket is entirely made of heat-dissipating material, the housing-type heat-dissipating lamp bracket comprising an elongate groove configured to detachably receive the elongate protruding beam; and several radiating hole devices set at a head and a tail of the lamp bracket, wherein the radiating hole devices of the housing-type heat-dissipating lamp bracket and a gap between the LED modules form a mutually-reinforcing thermal honeycomb effect, and when cooperating with ventilation hole of the lamp cover, a heat dissipation channel with unhindered air convection is formed, and wherein the radiating holes devices include several arrays of radiating holes.

2. The LED lighting device of claim 1, wherein several supporting members are set on the housing-type heat-dissipating lamp bracket, several mating members are set on the corresponding positions of the lamp cover and, when the LED lighting device is in a closed state, the supporting members are connected with the corresponding mating members for fixation.

3. The LED lighting device of claim 1, wherein the housing-type heat-dissipating lamp bracket and the lamp cover are connected through the supporting members, a gap remains between the housing-type heat-dissipating lamp bracket and the lamp cover, gaps remain between two adjacent modules, and between modules and the lamp cover.

4. The LED lighting device of claim 1, wherein:

the LED module comprises a PCB board, a LED light source module and a heat sink, and the LED light source module and the heat sink are placed separately at the two sides of the PCB board;

when the protruding beam is set in, it is tightly fitted with the groove; and if there are several LED modules, the heat dissipation channel also comprises gaps reserved between the LED modules.

5. The LED lighting device of claim 1, wherein a positioning notch is set on the heat sink and a corresponding screw hole is set on the housing-type heat-dissipating lamp bracket, and a hand screw passes through the positioning notch and the screw hole, thereby fixing the heat sink and the housing-type heat-dissipating lamp bracket.

6. The LED lighting device of claim 1, wherein a connection structure is provided at the tail of the housing-type heat-dissipating lamp bracket, and the connection structure is cast together with the housing-type heat-dissipating lamp bracket, and a threaded hole is set on the connection structure to coordinate with a pressing plate.

7. The LED lighting device of claim 1, further comprising a heat sink cut from aluminum alloy sections, a solid silicone ring is set at the fitting place of the heat sink and a lens assembly, liquid silicone is pasted at the sides of the solid silicone ring, and a wedge silicone ring and a metal nut are provided for fixation at the outlet hole of the waterproof wire at the back of the LED module.

8. The LED lighting device of claim 1, wherein the lamp cover is molded by plastic injection or cast with aluminum, and the lamp cover is connected to the housing-type heat-dissipating lamp bracket through several hinges on one side thereof.

9. The LED lighting device of claim 1, wherein a power supply holder and a mounting bracket are set on the housing-type heat-dissipating lamp bracket, a power supply is set on the beam of the power supply holder, and standing legs of two sides of the mounting bracket are installed on standing legs of the power supply holder.

10. An LED lighting device, comprising:

a lamp housing;

at least one LED module;

several radiating hole devices set at a head and a tail of the lamp housing, wherein the radiating hole devices and a gap between the LED modules form a mutually-reinforcing thermal honeycomb effect and further cooperate with the side face of the lamp housing to form a radiating channel having smooth air flow, or radiating hole devices set at two sides of the lamp housing and the radiating hole devices at the two sides and the gap between the LED modules form a heat dissipation channel with unhindered air convection, wherein the LED module comprises:

at least a heat sink;

a circuit board;

an LED lens unit; and an elongate protruding beam, wherein the lamp housing comprises a housing-type heat-dissipating lamp bracket having an elongate groove configured to detachably receive the elongate protruding beam, wherein two ends of the heat sink have a wedge groove structure with a positioning notch set at the end thereof, the LED module is fixedly installed through the positioning notch on the corresponding protruding beam on the lamp housing, a convex platform for installing screws is set at a position corresponding to the protruding beam, and heat of the LED module is transferred through the wedge groove to the protruding beam, forming a heat dissipation channel, and wherein the radiating holes devices include several arrays of radiating holes.

11. The LED lighting device of claim 10, wherein a lamp pole supporting part is set at the end of the lower lamp housing, the lamp pole support part can be cast together with the lower lamp housing, and a threaded hole on the lamp pole support part of the lower lamp housing is set to cooperate with a sheet metal connecting fastener, which is for connecting the complete lamp with the lamp pole.

12. The LED lighting device of claim 10, wherein a side frame assembly is on the side of the lamp housing, the side frame assembly is formed by engaging a web side wall and the external surface of a side frame base, setting of radiating holes on the two side walls of the lamp housing further includes the web side wall composed of meshes, and size and density of the meshes are set as per the dissipation requirements.

13. The LED lighting device of claim 10, wherein the housing-type heat-dissipating lamp bracket is set on the lamp housing, on the tail assembly of the housing-type heat-dissipating lamp bracket, at least two lamp pole supporting parts for connecting the lamp pole are set with a certain distance remaining therebetween to prevent overloading of the lamp pole support part leading to deformation of the lamp housing, wherein the lamp pole supporting parts could be cast together with the housing-type heat-dissipating lamp bracket, or set separately from the housing-type heat-dissipating lamp bracket and fixed.

14. The LED lighting device of claim 10, wherein on the tail assembly of the housing-type heat-dissipating lamp bracket, a power supply installation position is set with a convex structure, the power supply and the convex structure are tightly fitted for effectively transferring the heat generated by the power supply, and a water leakage hole is set besides the convex structure to prevent rainwater accumulation from affecting the performance of the power supply.

15. The LED lighting device of claim 10, wherein one side of a lamp cover is connected to the housing-type heat-dissipating lamp bracket with several hinges to make the lamp cover open and close freely along the side frame assembly, the module is fixed on the protruding beam of the housing-type heat-dissipating lamp bracket through a hand screw, and the lamp pole is fixed on the tail of the housing-type heat-dissipating lamp bracket by a pressing plate.

* * * * *